US011161124B2

(12) United States Patent
Stone et al.

(10) Patent No.: US 11,161,124 B2
(45) Date of Patent: Nov. 2, 2021

(54) SYSTEM AND METHOD FOR SEPARATING PARTICLES IN SUSPENSION UTILIZING BUBBLES

(71) Applicant: The Trustees of Princeton University, Princeton, NJ (US)

(72) Inventors: Howard A. Stone, Princeton, NJ (US); Sepideh Khodaparast, London (GB); Yingxian Yu, Plainsboro, NJ (US)

(73) Assignee: THE TRUSTEES OF PRINCETON UNIVERSITY, Princeton, NJ (US)

( * ) Notice: Subject to any disclaimer, the term of this patent is extended or adjusted under 35 U.S.C. 154(b) by 284 days.

(21) Appl. No.: 16/381,136

(22) Filed: Apr. 11, 2019

(65) Prior Publication Data

US 2019/0314826 A1 Oct. 17, 2019

Related U.S. Application Data

(60) Provisional application No. 62/656,152, filed on Apr. 11, 2018.

(51) Int. Cl.
*B03B 5/62* (2006.01)

(52) U.S. Cl.
CPC ..... *B03B 5/62* (2013.01)

(58) Field of Classification Search
CPC .. B03B 5/00; B03B 5/62; B03B 5/623; B03B 13/00; B03B 13/02
See application file for complete search history.

(56) References Cited

U.S. PATENT DOCUMENTS 3,550,771 A * 12/1970 Spyropoulos ..... G01G 19/41 209/559
3,982,691 A 9/1976 Schlutz
(Continued)

OTHER PUBLICATIONS

P. E. Lindahl. "Principle of a counter-streaming centrifuge for the separation of particles of different sizes," Nature, vol. 161, pp. 648-649 (Apr. 24, 1948).
(Continued)

*Primary Examiner* — Joseph C Rodriguez
(74) *Attorney, Agent, or Firm* — Meagher Emanuel Laks Goldberg & Liao, LLP

(57) ABSTRACT

Disclosed is a process for separating suspended particles based on size. When confined in a tube, a bubble moves relative to the liquid as a small fraction of the liquid leaks backwards through a very thin gap between the bubble and the internal wall of the tube. The lubricating film formed around the bubble can be fine-tuned by simply changing the average flow speed. With this thin film of liquid, the confined air bubble can be used to separate particles in, for example, poly-disperse microspheres suspensions. As the bubble passes through the suspension, only particles smaller than the liquid gap thickness can leak through the gap towards the back of the bubble, resulting a filtered particle suspension containing only small particles at the back of the bubble. Compared to the traditional methods, this particle separation process is easy to perform, and is flexible in filtering different suspensions with one set-up. Due to the flexibility of the bubble interface and the special film thickness profile of a translating confined bubble, this process also avoids clogging, and can be easily adapted to, e.g., separate different poly-disperse suspensions based on size.

20 Claims, 4 Drawing Sheets

(56) References Cited

U.S. PATENT DOCUMENTS

| | | | | |
|---|---|---|---|---|
| 6,046,056 | A * | 4/2000 | Parce | G01N 33/5094 506/39 |
| 6,454,924 | B2 * | 9/2002 | Jedrzejewski | B01J 19/0046 204/601 |
| 6,660,517 | B1 * | 12/2003 | Wilding | B01D 61/18 422/129 |
| 6,911,183 | B1 * | 6/2005 | Handique | B01F 5/0085 422/502 |
| 8,802,449 | B2 * | 8/2014 | Kakuta | G01N 33/54313 436/535 |
| 2003/0017609 | A1 * | 1/2003 | Yin | G01N 27/44791 436/161 |
| 2003/0190608 | A1 * | 10/2003 | Blackburn | B01L 7/525 435/6.11 |
| 2004/0067166 | A1 * | 4/2004 | Karinka | B01L 3/502723 422/82.03 |
| 2011/0017645 | A1 * | 1/2011 | Hongo | B03B 5/00 209/157 |

OTHER PUBLICATIONS

R. W. Sheldon, "Size separation of marine seston by membrane and glass-fiber filters" Limnology and Oceanography 17, 494-498(1972).
R. W. Baker, "Membrane Technology" (Wiley Online Library. 2000).
D. Aussawasathien, et al. "Separation of micron to sub-micron particles from water: Electrospun nylon-6 nanofibrous membranes as pre-filters" Journal of Membrane Science 315 (2008) 11-19.
J. Calvin Giddings, "Field-Flow Fractionation: Analysis of Macromolecular, Colloidal, and Particulate Materials", Science, New Series, vol. 260, No. 5113 (Jun. 4, 1993), pp. 1456-1465.
C. Wyatt Shields IV, Catherine D. Reyes, Gabriel P. López, "Microfluidic cell sorting: a review of the advances in the separation of cells from debulking to rare cell isolation", Lab Chip, 2015, 15, 1230, DOI: 10.1039/c4lc01246a.
John Oakey, Josh Allely, and David W. M. Marr, "Laminar-Flow-Based Separations at the Microscale", Biotechnol. Prog. 2002, 18, 1439-1442.
Masumi Yamada, Megumi Nakashima, and Minoru Seki, "Pinched Flow Fractionation: Continuous Size Separation of Particles Utilizing a Laminar Flow Profile in a Pinched Microchannel", Anal. Chem. 2004, 76, 5465-5471.
Ali Asgar S. Bhagat, Sathyakumar S. Kuntaegowdanahalli and Ian Papautsky: "Continuous particle separation in spiral microchannels using dean flows and differential migration", Lab Chip, 2008, 8, 1906-1914.
Jae-Sung Park and Hyo-Il Jung: "Multiorifice Flow Fractionation: Continuous Size-Based Separation of Microspheres Using a Series of Contraction/Expansion Microchannels", Anal. Chem. 2009, 81, 8280-8288.
Sathyakumar S. Kuntaegowdanahalli et al.: "Inertial microfluidics for continuous particle separation in spiral microchannels", Lab Chip, 2009, 9, 2973-2980.
Lotien Richard Huang et al.: "Continuous Particle Separation Through Deterministic Lateral Displacement" Science, vol. 304, May 14, 2004.
Sung-Cheol Kim et al.: "Broken flow symmetry explains the dynamics of small particles in deterministic lateral displacement arrays", Proc. Natl. Acad Sci. USA, 201706645 (2017).
Sangwoo Shin et al.: "Membraneless water filtration using CO2", Nature Communications, 8, 15181 (2017).
David Holmes & Hywel Morgan: "Cell Positioning and Sorting Using Dielectrophoresis", European Dells and Materials vol. 4. Suppl. 2, 2002 (pp. 120-122).
Nicole Pamme et al.: "On-chip free-flow magnetophoresis: Separation and detection of mixtures of magnetic particles in continuous flow", Journal of Magnetism and Magnetic Materials 307 (2006) 237-244.
David McGloin: "Optical tweezers: 20 years on", Phil. Trans. R. Soc. A (2006) 364, 3521-3537.
Sherrif F. Ibrahim et al.: "Flow Cytometry and Cell Sorting", Cell Separation (Springer, 2007) 106: 19-39.
Xiaoguang Lin et al.: "Effective Cell and Particle Sorting and Separation in Screen-Printed Continuous-Flow Microfluidic Devices with 3D Sidewall Electrodes", Ind. Eng. Chem. Res. 55, 13085-13093 (2016).
Daniel R. Gossett et al.: "Label-free cell separation and sorting in microfluidic systems", Anal Bioanal Chem (2010) 397:3249-3267.
F. Fairbrother et al.: "119. Studies in electro-endosmosis. Part VI. The "bubble-tube" method of measurement", J. Chem. Soc., 527-529 (1935).
F. P. Bretherton: "The motion of long bubbles in tubes", J. Fluid Mech. 10, 166-188 (1961).
G. I. Taylor: "Deposition of a viscous fluid on the wall of a tube", J. Fluid Mech. 10, 161-165 (1961).
Harris Wong et al.: "The motion of long bubbles in polygonal capillaries. Part 1. Thin films", J. Fluid Mech. (1995), vol. 292, pp. 71-94.
Pascale Aussillous et al.: "Quick deposition of a fluid on the wall of a tube", Physics of Fluids 12, 2367 (2000).
Matthias Heil: "Finite Reynolds number effects in the Bretherton problem", Physics of Fluids 13, 2517 (2001).
S. Khodaparast et al.: "Dynamics of isolated confined air bubbles in liquid flows through circular microchannels: an experimental and numerical study", Microfluid Nanofluid (2015) 19:209-234.
Omer Atasi et al.: "Effect of buoyancy on the motion of long bubbles in horizontal tubes", Physical Review Fluids 2, 094304 (2017).
Anand Bala Subramaniam et al.: "Semi-permeable vesicles composed of natural clay", Soft Matter, 2011, 7, 2600.
Anthony P. Kotula et al.: "Probing timescales for colloidal particle adsorption using slug bubbles in rectangular microchannels", Soft Matter, 2012, 8, 10759.
Farzam Zoueshtiagh et al.: "Capillary tube wetting induced by particles: towards armoured bubbles tailoring", Soft Matter, 2014, 10, 9403-9412.
Yingxian Estella Yu et al.: "Armoring confined bubbles in the flow of colloidal suspensions" Soft Matter, 2017, 13, 2857.
Carlos E. Colosqui and Jeffrey F. Morris: "Hydrodynamically Driven Colloidal Assembly in Dip Coating", PRL 110, 188302 (2013).
S. Khodaparast et al.: "Application of micro particle shadow velocimetry IPSV to two-phase flows in microchannels", International Journal of Multiphase Flow 62, 123-133, (2014).
D. Vella et al.: "Elasticity of an interfacial particle raft", Europhys. Lett., 68, (2), pp. 212-218 (2004).
Technical Data Sheet, Microbeads 92009), Spheromers CA6 CA10 CA15 CA20 CA30 CA40 CA60, Year: 2009.
Carpentier, C.E. "Three-dimensional visualization of contact networks in granular material" Universiteit van Amsterdam, 2013, Chap. 5, pp. 118-122.
Gary F. Teletzke et al.: "Wetting hydrodynamics", Revue Phys. Appl. 23 (1988) 989-1007.
Naima H. Hammoud et al.: "Influence of van der Waals forces on a bubble moving in a tube", Physical Review Fluids 2, 063601 (2017).
J. Takagi et al.: "Continuous particle separation in a microchannel having asymmetrically arranged multiple branches", Lab Chip, 2005, 5, 778-784.

* cited by examiner

SYSTEM AND METHOD FOR SEPARATING PARTICLES IN SUSPENSION UTILIZING BUBBLES

CROSS-REFERENCE TO RELATED APPLICATIONS

This application claims priority to U.S. Provisional Application No. 62/656,152, filed Apr. 11, 2018, which is herein incorporated by reference in its entirety.

BACKGROUND

Currently particle separation mechanisms include centrifugation, dialysis, and mechanical filtration, where centrifugal separation and dialysis processes suffer from their high cost, and mechanical filtration has a potential clogging concern. To increase the speed of separation, the processes above are also limited to a system where the particles are suspended in a continuous phase with low viscosity. Therefore, they are not suitable for separating particles that are suspended in a viscous fluid.

BRIEF SUMMARY

The present invention is drawn to a system and method for separating suspended particles from a fluid or from particles of a different size.

A first aspect is drawn to a system that includes at least one channel, such as a capillary tube, that has a fixed diameter as well as an inlet and outlet. In the channel exists a fluid containing suspended particles. A non-spherical, long and confined bubble is generated at the inlet, where the bubble is controlled so as to have a gap between an outer surface of the bubble and an inner surface of the channel. The system is adapted such that the thickness of the gap is controlled by a flow rate within the channel containing the suspended particles. As the bubble passes through the fluid containing suspended particles, particles with a characteristic dimension smaller than the thickness of the gap can leak through the gap, while those with a larger characteristic dimension are collected by the bubble interface and not allowed to leak through the gap. In certain embodiments, an annular gap having a uniform thickness forms between the outer surface of the bubble and the inner surface of the channel. This thickness may be smaller than the diameter of at least one of the suspended particles. In certain embodiments, the thickness of the gap is adjustable, and capable of being adjusted to between about 0.1 μm to about 1 mm. In certain embodiments, the flow rate of the first fluid may be controlled such that the capillary number (Ca) is $1\times10^{-4}<Ca<2$, where $Ca=\mu U_b/\gamma$, and where μ is the viscosity of the fluid, $U_b$ is the velocity of the bubble, and γ is the surface tension. In certain embodiments, the density of the suspended particles may be substantially equal to the density of a fluid. In certain embodiments, the first fluid, second fluid, and suspended particles may be selected such that there exist attractive intermolecular interactions between the particles and the interface between the first and second fluids. In certain embodiments, the second fluid may be a gas. In certain embodiments, the channel is oriented in a substantially vertical or substantially horizontal direction. In certain embodiments, the system may also include a pump or syringe operably connected to the inlet of the channel, a camera able to receive light passing through the channel, or one or more additional channels.

A second aspect is drawn to the method of separating particles. The method includes flowing a fluid with suspended particles into a channel, then creating a non-spherical, long and confined bubble at one end, the bubble having a gap between an outer surface of the bubble and an inner surface of the channel. A flow rate within the channel is controlled such that the thickness of the gap is insufficient to allow a particle to leak through the gap and enter a volume of space upstream of the bubble, which may include absorbing the first particle on an interface of the bubble. The bubble may flow through the suspension by, e.g., allowing the bubble to rise naturally through a substantially vertical channel, continuously feeding suspension to the top and keeping the bubble relatively stationary in a vertical channel, or by flowing additional fluid without the suspended particles into a horizontal channel after the bubble is generated. Additional bubbles and additional fluid may also be later introduced. In certain embodiments, the flow rate of the bubble is controlled such that the gap is large enough to allow at least one particle to leak through the gap and enter the volume of space upstream of the bubble. In certain embodiments, the particles may have a minimum characteristic dimension of between 0.1 μm and 1 mm. The method may also include collecting a sample of the fluid ahead of the bubble and quantifying particle size distribution, and/or collecting a sample of the fluid behind the bubble and quantifying particle size distribution.

DETAILED DESCRIPTION OF THE INVENTION

Figure 1:
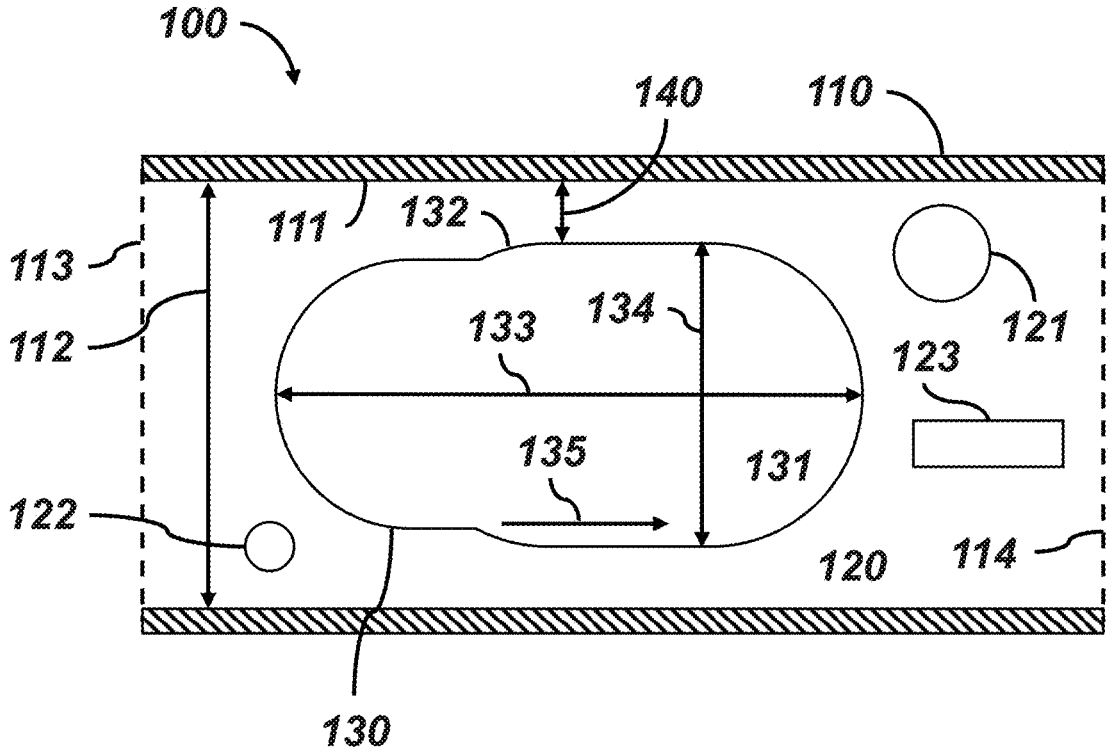
FIG. 1 is a diagram of one embodiment of the disclosed system.

As used herein, the term "about [a number]" is intended to include values rounded to the appropriate significant digit. Thus, "about 1" would be intended to include values between 0.5 and 1.5, whereas "about 1.0" would be intended to include values between 0.95 and 1.05.

As used herein, the term "between [two numbers]" is inclusive of both numbers.

As used herein, the term "substantially equal" to a value is intended to include values that are within ±10% of the indicated value. As an example, a first density that must be "substantially equal" to a second density of 1.0 g/cm$^3$ indicates the first density must be between about 0.9 g/cm$^3$ and about 1.1 g/cm$^3$.

As used herein, the term "substantially horizontal" and "substantially vertical" are intended to include orientations that are within ±5 degrees of horizontal or vertical, respectively.

The present invention is drawn to a system and method for separating suspended particles, using a long bubble confined in a circular capillary filled with a complex liquid such as a colloidal suspension, to sort particles within the capillary.

Conceptually, the system can be envisioned by considering a reference frame translating at the bubble velocity $U_b$, where most of the liquid phase in the front and at the back of the bubble remains on separate streamlines and do not mix with one another. However, a fraction of the liquid ahead of the bubble leaks towards the back of the bubble through an annular liquid-filled gap of uniform thickness b around the bubble. In the limit of negligible buoyancy and inertial effects, the normalized thickness of the pure liquid film is determined by the capillary number $$Ca \equiv \frac{\mu U_b}{\gamma}:$$

$$\frac{b}{R} = \frac{1.34Ca^{2/3}}{1 + 3.5Ca^{2/3}} \quad (1)$$

Following a flow field close to the wall, a fraction of the particles ahead of the bubble are directed backward through the annular gap. Consider a surfactant-free and dilute Newtonian colloidal suspension (CS) with non-polar solute and uncharged particles fully wetted by the liquid. With the thickness (h(x)) of the fluid gap between the bubble surface and the solid boundary, particles with diameter $d_p$ smaller than h(x) at the front stagnation ring are expected to enter the thin film region.

It may be considered that the particle-interface interaction is due to the intermolecular attractions, such as van der Waals forces. Thus, these particles are expected to experience at least two distinct fates, depending on the ratio of their diameter $d_p$ to the uniform film thickness b, i.e., $d_p/b$.

If a particle of diameter $d_p<b$ enters the thin liquid film, the minimum gap between the free interface and the particle boundary is $h(x) \leq b-d_p$. This film may rupture and cause the particle to rest on the interface when the intermolecular forces overcome the capillary effects, which requires h(x) to be as small as hundreds of nanometers, if not tens of nanometers. Therefore, unless $d_p$ approximates b, or the particles are sliding in close vicinity to the bubble surface, suspended colloids with diameters smaller than the liquid film thickness ($d_p/b<1$) are expected to reach the region behind the bubble without interacting significantly with the interface.

However, for particles with diameters sufficiently larger than the thickness of the film ($d_p/b>1$), the probability of particle absorption on the interface increases significantly. Since surface tension counteracts the interface deformation, large particles in the thin film region can be considered as always sliding in close vicinity to the bubble surface. Therefore, the bubble surface will likely absorb all the larger particles entering the thin film region and can serve as a filter for colloids of diameters larger than the thickness of the liquid film ($d_p/b>1$). Larger particles are absorbed and filtered out from the fluid, remaining at the interface of the bubble and the fluid, while smaller particles are allowed to enter a volume of space behind the bubble. In some embodiments where the system utilizes a liquid drop, some or all of the larger particles may also become engulfed within the liquid drop, rather than just remaining at the interface.

Disclosed is a system for separating suspended particles that utilizes this conceptual approach. Referring to FIG. 1, the system (100) generally includes a channel (110). The channel (110) may have an inner surface (111) having a fixed inner diameter (112). In certain embodiments, the central axis of the channel is oriented in a substantially vertical or substantially horizontal direction. Note that the tolerable angle is related to the tube diameter and the speed of the bubble, which correspond to Bond number (Bo) and Ca, respectively. Note that $$Bo = \frac{\rho g r^2}{\gamma},$$

where ρ is the fluid density, g is the gravitational acceleration, r is the tube/channel radius, and γ is the surface tension. Gravity effects will become more significant with the increase of any of the two non-dimensional numbers and can cause the bubble to tilt with respect to the tube, leading to film rupture. Thus, in certain preferred embodiments, the central axis of the channel is oriented within ±1 degree of vertical or horizontal direction. In certain embodiments, the central axis of the channel is oriented vertically or horizontally.

While straight channels are preferred, channels with curves are also envisioned, although the curve will necessarily require the bubble to be closer to one side of the channel than the other, which may allow larger particles than intended to pass to the rear of the bubble unless carefully designed. In some embodiments, a helical-shaped channel with a constant radius of curvature is utilized.

There is no restriction on the length of the channel, although in some embodiments, the channel is less than 1 meter in length.

While the inner diameter of the channel is not strictly limited, and the exact dimensions are fluid property dependent, in certain embodiments, such as when the tube is oriented horizontally, the inner diameter (112) may have be bound by the minimum diameter capable of maintaining a stable film thickness and a maximum diameter capable of ensuring a roughly uniform film thickness (e.g., Bond number <0.1). In certain embodiments, this fixed inner diameter (112) is between about 10 μm and about 5 mm. In certain embodiments, this fixed inner diameter (112) is between about 50 μm and about 5 mm. For example, for a horizontal capillary, an estimate for the smallest diameter for a uniform film thickness of b>100 nm at a $Ca=10^{-4}$ can be calculated as $b/R=0.643(3Ca)^{2/3}$, which can be rearranged as $b=0.643(3Ca)^{2/3}R>100$ nm. From there, $D_{min}$ can be calculated as $D_{min}=2R=70$ μm.

Similarly, for a horizontal capillary, the upper limit can be estimated by determining the maximum radius, for a given fluid, at which the Bond number is <0.1. As examples, the estimated maximum diameter for a horizontal channel is about 1.7 mm for water, about 1.07 mm for ethanol, about 1.43 mm for glycerol, and about 0.922 mm for a silicone oil.

The inner surface (111) also describes a first opening at a first end (113) and a second opening at a second end (114) of the channel (110).

Within the channel (110), there is a fluid (120) containing suspended particles (121, 122, 123) and a non-spherical bubble (130). There are no real restrictions on the compositions of the fluid, bubble and particles, provided (i) the particles can be fully wetted by the fluid, and (ii) the materials form a finite three-phase contact angle. The first requirement makes sure that particles do not aggregate in the continuous phase, and thus the separation is achieved based on individual particle sizes. The second requirement ensures the absorbed particles state is energetically preferable compared to the suspended state.

Non-limiting examples of the fluid include water, ethanol, acetone, glycerol, silicone oils at various viscosities, blood, or blood plasma. While any fluid may be theoretically be used, in certain embodiments the fluid viscosity may be between about $1\times10^{-4}$ and 1 Pa-s.

Within the channel, particles are suspended in the fluid (120). The particles may be spherical (121, 122) or non-spherical (123). The particles may have minimum characteristic dimensions that allow the particles to be filtered by the system. For spherical particles (121, 122), the minimum characteristic dimension is the diameter. For non-spherical particles (123), the minimum characteristic dimension is the maximum span of the particle motion in the flow direction, which is the maximum possible dimension in which the particle might interact with the interface. For example, for a rod-shaped particle (123), the minimum characteristic dimension may be the smaller of the length, width, or thickness of the rod. If the particle rotates, the minimum characteristic dimension should characterize the space enclosing the maximum range of the rotational motion and should be measured normal to the tube axis. For example, if a disk (cylindrical-rod-shape particle with minimum dimension in thickness) is rotating with respect to an axis that is one of the top surface diameters, the characteristic dimension will be the diameter instead of the thickness. Other particle shapes may have other minimum characteristic dimensions as is known in the art.

While any particle composition is envisioned, biological (including but not limited to cells) and/or polymeric particles (including but not limited to polymers having hydrocarbon monomers or acrylate monomers) may be utilized, including but not limited to poly(methyl methacrylate) (PMMA), polystyrene (PS), polyethylene (PE), silica particles, etc.

A non-spherical bubble (130) is located within the first fluid (120). The bubble (130) comprises a second fluid (131)—which may be a gas (including but not limited to gases such as air, N2, O2, or CO2), or a liquid. For example, the bubble could comprise a second fluid (131) that is immiscible in the first fluid (120). In instances where the bubble comprises a liquid, the bubble may be referred to as a drop or a droplet. Some examples of systems utilizing liquid bubbles includes: (a) where the continuous fluid is mineral oil, the suspended particles include PMMA, and the droplet is water; (b) where the continuous fluid is mineral oil, the suspended particles include PS, and the droplet is glycerol; (c) where the continuous fluid is ethylene glycol, the suspended particles include iron oxyhydroxide (FeOOH), and the droplet is mineral oil; and (d) where the continuous fluid is cyclohexane, the suspended particles include PS, and the droplet is water.

The bubble (130) has a length (133) and diameter (134). The bubble (130) is configured to have a gap (140) between an outer surface of the bubble (132) and an inner surface of the channel (111), and the bubble (130) is not in contact with the channel (110). In certain embodiments, the outer surface of the bubble (132) and the inner surface of the channel (111) define an annular gap having a uniform thickness where the thickness is smaller a diameter of one or more of the particles (e.g., the thickness of gap 140 is smaller than the diameter of particle 121). In other embodiments, for example where the channel is curved, the gap on the inner side of the turn will be smaller than the gap on the other. In such embodiments, the largest gap is the critical thickness that determines what size particles will be filtered.

There is no theoretical upper bound for the bubble length (133). In some embodiments, it may be up to 100 times the fixed inner diameter (112). In other embodiments, it is between 2 and 50 times the fixed inner diameter. In still other embodiments, it is between 2 and 10 times the fixed inner diameter.

In certain embodiments, the fluid and the bubble will enter through the same end of the channel and will exit through the same end of the channel. In other embodiments, the fluid will enter one end and the bubble will enter the other end. For example, in a vertical channel orientation, it may be advantageous in some embodiments to add fluid with suspended particles through the top of the channel, generate the bubble at the bottom of the channel, and allow the bubble to rise through the fluid. Alternatively, in a vertical channel, one could flow additional suspended particles through the top of the channel at a slow enough feed rate so as to keep the bubble relatively stationary and allow the filtered particles to pass through the bottom of the vertical channel.

The system should be configured such that a thickness of the gap (140) is capable of being controlled by a flow rate within the channel (e.g., controlling the velocity (135) of the bubble (130) relative to the fluid (120) within the channel (110)). In various embodiments, this may involve controlling the velocity of the bubble as it moves from one end of the channel to the other (e.g., by using an appropriately configured system to properly make use of the buoyancy effects, or by controlling the flow rate of fluid being added to move the bubble through the channel), controlling the velocity of the fluid flowing past a relatively stationary bubble, or some combination of the two. Of note, and as illustrated in FIG. 1, while the critical film region used for particle separation in the front of the bubble may have a uniform film thickness, that portion may not be the maximum film thickness along the bubble surface. In certain embodiments, a portion of the rear bubble surface has a different film thickness than a portion of the front bubble surface. In some embodiments, the thickness of the gap is capable of being adjusted to be between about 0.1 μm and about 1 mm.

In certain embodiments, the flow rate of the fluid (120) or bubble (135) is controlled such that the capillary number (Ca) is $1\times10^{-4}<Ca<2$. In other embodiments, the flow rate is controlled such that $5\times10^{-3}<Ca<5\times10^{-1}$.

In certain embodiments, for a horizontally oriented channel, the fluid velocity may be between about $1\times10^{-8}$ m/s and about 5 m/s. These values may be estimated based on fluid properties, and, e.g., an appropriate channel diameter, such as approximately 1 mm. The lower bound is estimated based on the minimum stable film thickness (e.g., 100 nm). With $b/R=0.643(3Ca)^{2/3}$, and $Ca=\mu U/\gamma$, estimating the minimum U is relatively straightforward. As examples, the following minimum fluid velocities can be estimated: about $1.48\times10^{-4}$ m/s for water, about $3.66\times10^{-5}$ m/s for ethanol, about $1.19\times10^{-7}$ m/s for glycerol, about $7.83\times10^{-6}$ m/s for 5 cSt silicone oil, and about $4\times10^{-8}$ m/s for 1000 cSt silicone oil.

The upper bound for fluid velocity in a horizontal channel may be estimated based on the critical Stokes number (e.g., St<1), below which the particles can be considered well following the streamline. Given $$St=\left(\frac{\rho_p d_p^2}{18\mu}\right)\Big/\left(\frac{b}{U}\right)<1,$$

and given an estimated tube diameter=1 mm, neutrally buoyant particles ($\rho_p\approx\rho$) and film thickness b being comparable with the particle diameter $d_p$ ($b\approx d_p$), the calculations for a maximum U are straightforward. As examples, the following maximum fluid velocities can be estimated: about 0.62 m/s for water, about 0.46 m/s for ethanol, about 2.06 m/s for glycerol, about 0.54 m/s for 5 cSt silicone oil, and about 1.56 m/s for 1000 cSt silicone oil. Thus, in certain embodiments, neutrally buoyant particles are desired, and the density of one or more of the particles is substantially equal to a density of the fluid.

In certain embodiments, the first fluid, the second fluid, and the particles are selected such that attractive intermolecular interactions exist between the particles and the interface between the first and second fluids.

Figure 2:
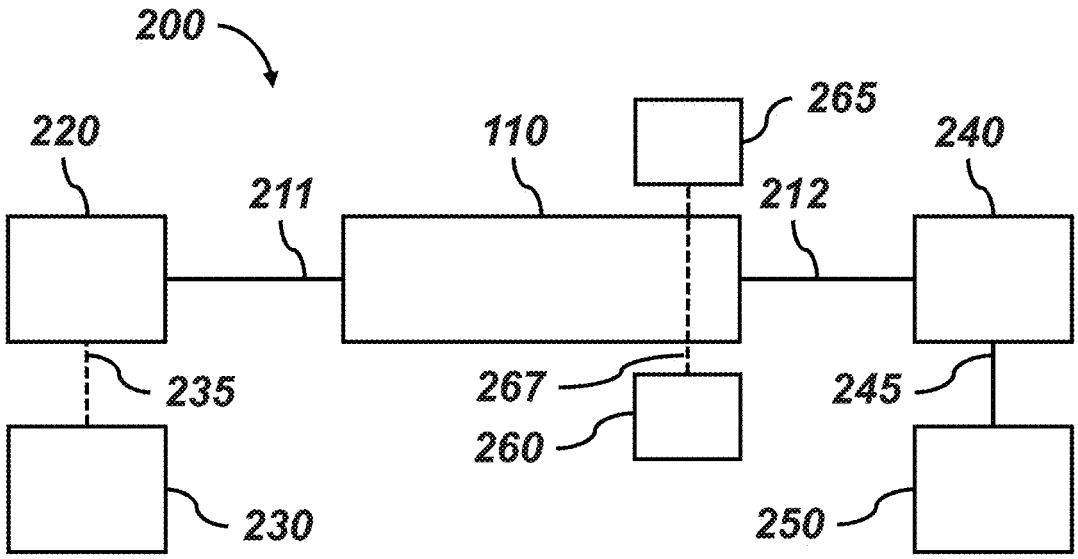
FIGS. 2 and 3 are block diagrams of two additional embodiments of the disclosed system.
Figure 3:
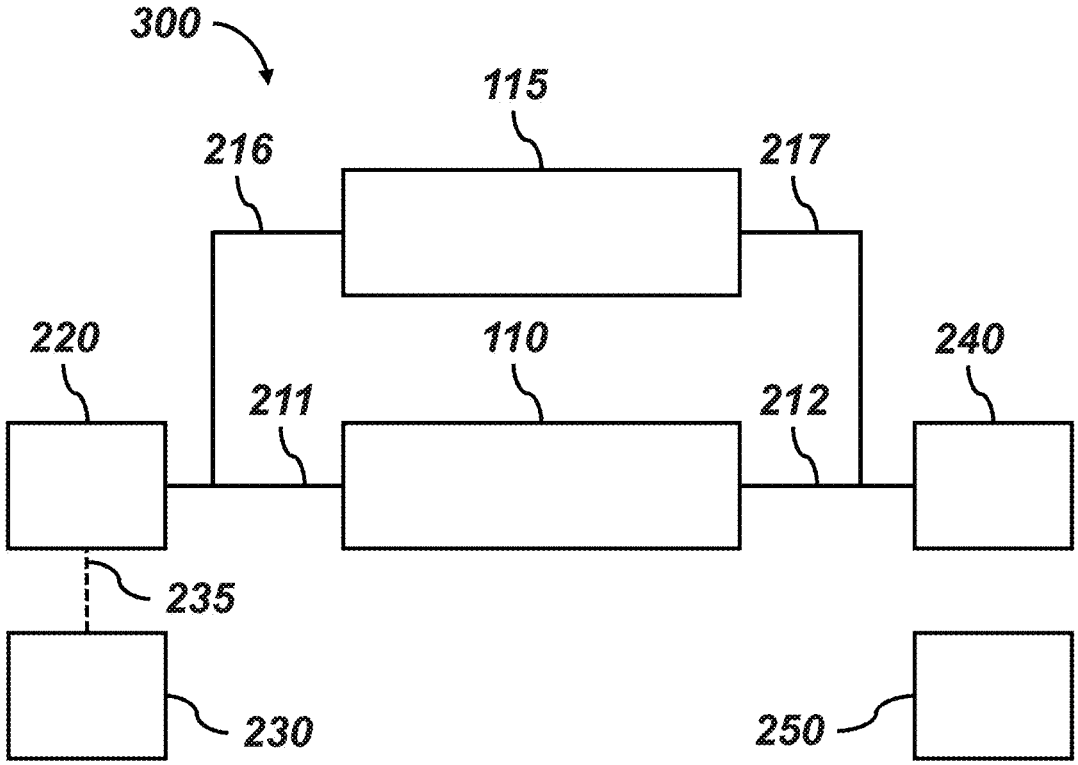

Referring to FIGS. 2 and 3, systems (200, 300) may include other components. As seen in FIG. 2, one embodiment of a system (200) has one end of a channel (110) operably connected (211) to one or more pumps (220). The pump (220) pulls from a reservoir of fluid and provides the fluid to the channel. As is understood in the art, the pump (220) may alternately be replaced by, e.g., a syringe, an elevated reservoir using gravity to feed the channel, or other known technique for providing a fluid to the first end of the channel (110). In certain embodiments, the pump (220) may be connected to one or more valves or manifolds. In certain embodiments, the channel is selectively connected to (i) a pump, syringe, or other means for providing the fluid with suspended particles, (ii) a pump, syringe, or other means for providing the fluid with the fluid without the suspended particles, and/or (iii) a pump, syringe, or other means (e.g., a regulated $O_2$ tank) for providing the fluid for the bubble using, e.g., one or more processor-controlled three-way valves.

The system may also include one or more controllers (230), which can control some or all of the components in the system. As shown in FIG. 2, the controller (230) sends and receives signals (235) from the pump, valves, and/or manifold (220) in order to control fluid flow to the channel (110).

The system may also include a means for collecting fluid (240) operably connected (212) to the second end of the channel (110). This may be as simple as having the capillary flow into one or more jars, beakers, or other containers. Alternatively, it may involve one or more valves. For example, in certain embodiments, the means for collecting fluid is a glass or glass-lined container into which the fluid from the capillary is flowed. The means for collecting fluid may include valves, etc. For example, a three-way valve can be used to send the fluid with large particles—e.g., the fluid ahead of one of the bubbles—to one container, and the filtered fluid—e.g., the fluid behind one of the bubbles—to another container.

Collected material may then be sent to be analyzed via various instrumentation (250). In FIG. 2, the material from the collection means (240) is shown as being sent inline (245) to an instrument (250), while in FIG. 3, it is transported via, e.g., hand delivery from the collection means (240) to the instrument(s) (250). In some embodiments, the analytical instruments include a particle size analyzer appropriate for the materials being processed. Other instrumentation may be used as understood by one of skill in the art, as appropriate for the material being tested. For example, other instrumentation may include, but is not limited to, mass spectrometers, gas chromatographs, cell counters, and/or hematology analyzers. The instrumentation may be automated, semi-automated, or non-automated. Further, although the instruments (250) in FIG. 2 are shown as being positioned after the collection means (240), one or more instruments (250) may be used before the collection means. For example, an in-line particle size analyzer may be used prior to the collection means for, e.g., quality control or process control purposes. Similarly, as shown in FIG. 2, other instrumentation such as a camera (260) can be positioned such that light passing through the channel (267) generated by a light source (265) can be captured to allow a user to, e.g., monitor the particle-interface interactions. In these instances, the fluid and at least a portion of the channel would preferably be transparent to at least one wavelength of light.

Sensors appropriate for various control schemes are utilized as understood by one of skill in the art.

As seen in FIG. 3, some systems (300) may include more than one channel. The device according to claim 1, wherein the device comprises a plurality of channels (110, 115). Each channel may separately be connected (211, 216) to a pump (220) (or syringe, etc.), and each channel may separately be connected (212, 217) to a collection means (240). In certain embodiments, the number of channels is between 2 and 1,000. In certain embodiments, the number of channels is between 2 and 100. In certain embodiments, each channel (110, 115) has the same diameter. In certain embodiments, at least one channel has a different diameter than the diameter of at least one other channel. In certain embodiments, the gap in at least one channel has a different thickness than the gap in at least one other channel.

While the channels are preferably arranged in parallel, the channels may also be arranged in series, or in some combination of the two.

Figure 4:
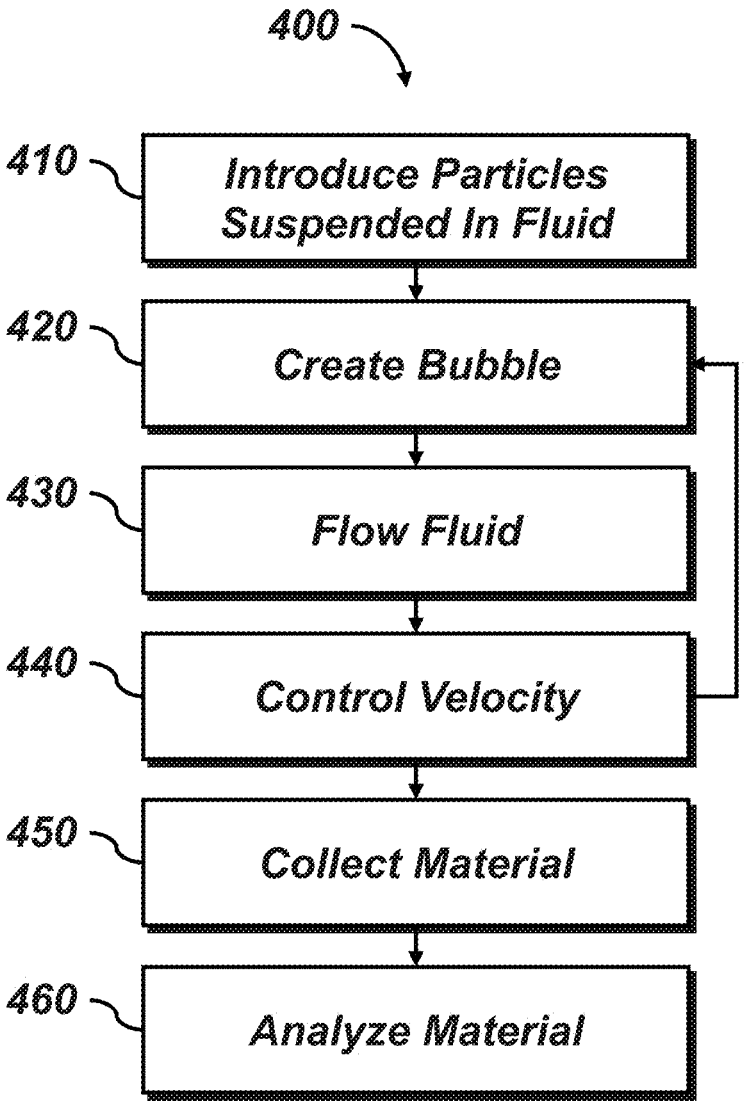
FIG. 4 is a flowchart depicting one embodiment of the disclosed method.

An embodiment of the disclosed method of separating particles can be seen in reference to FIG. 4. The method (400) begins by introducing (410) a fluid containing suspended particles to a channel. Typically, the entire channel is filled with the fluid containing suspended particles. A bubble (420) is then created at one end of the channel. In substantially vertical channels, this is typically the end at the bottom, in order to allow the bubble to rise through the channel. Optionally, the fluid without the suspended particles may be introduced (430) to the channel after the bubble is created. The velocity of the bubble through the channel is then controlled (440) in such a way such that the gap between an outer surface of the bubble and an inner surface of the channel has a uniform thickness insufficiently large to allow one of the suspended particles to leak past the bubble and enter a volume of space upstream of the bubble. Optionally, additional bubbles and additional fluid without suspended particles can be introduced to the channel.

Material from the channel can then optionally be collected (450). In some embodiments, fluid ahead of the bubble is collected. In some embodiments, fluid behind the bubble is collected. In some embodiments, material that is collected (450) may optionally be analyzed (460). In some embodiments, the particle size of the collected material is quantified.

EXAMPLES

To verify the existence of the two distinct fates for colloids based on $d_p/b$, experiments were performed in a L=50 cm long circular PYREX® borosilicate glass capillary with an inner radius of R=0.56 mm in a refractive index-matched setup. The glass capillary is initially filled with a colloidal suspension (CS) of neutrally buoyant poly(methyl methacrylate) (PMMA) particles that serves as the working fluid ahead of the bubble.

Various CSes were prepared by mixing the surfactant-free cross-linked dry poly(methyl methacrylate) (PMMA) microspheres in pure glycerol (VWR BDH Chemicals). Monodisperse microspheres of three different radii were used in preparing the suspensions (Microbeads Spheromers CA10, CA20, and CA40), whose reported values for size dispersity and average surface roughness are 5% and 5.4 nm, respectively. The density of PMMA microspheres is $\rho_p=1.2\times10^3$ kg $m^{-3}$ and matches that of the base liquid, thus the particles were neutrally buoyant in the suspensions. In addition, the cross-linked PMMA microspheres were rigid at room temperature, at which the experiments are performed. As a result, particle deformation was negligible and the PMMA particles can be considered rigid spheres during the experiments.

Suspensions of four different particle sizes and concentrations are used in the experiments. Concentrations of the suspensions are controlled by varying the mass of the microspheres (measured using an analytical balance, Sartorious Practum 124-1S) added to a fixed mass (100 g) of the base liquid before mixing, and the volume fractions $\phi$ are calculated based on the mass fractions and densities of the materials. Relatively low concentrations of particles are chosen to allow clear visualization of individual particles and limit the particle-particle interactions, which may otherwise lead to non-Newtonian behavior in the suspension at higher volume fraction. The densities, viscosities and surface tensions of the suspensions are measured after the colloids are well suspended using a magnetic stirrer. Fluid viscosities are measured in a rheometer (Anton Paar, Physica MCR 301), whilst surface tension measurements are performed using the pendant drop method. The physical properties of the working fluids used in the experiments are listed in Table 1, below.

TABLE 1

| Fluid | Particle Diameter $d_p$ (μm) | Mass Fraction (g particle per g glycerol) | Volume Fraction $\phi$ | Density $\rho$ (kg $m^{-3}$) | Viscosity $\mu$ (Pa s) | Surface Tension $\gamma$ (mN $m^{-1}$) |
|---|---|---|---|---|---|---|
| Pure Glycerol | — | 0 | 0 | 1.25 ± 0.01 | 1.06 ± 0.02 | 62.9 ± 0.7 |
| CS 1 | 10 | 1.0 wt % | $1.1\times10^{-2}$ | 1.26 ± 0.01 | 1.06 ± 0.01 | 62.9 ± 0.4 |
| CS 2 | 40 | 1.0 wt % | $1.1\times10^{-2}$ | 1.26 ± 0.01 | 1.05 ± 0.01 | 62.6 ± 0.3 |
| CS 3 | $d_{ps}$ = 10 | 0.5 wt % | $5.1\times10^{-3}$ | 1.25 ± 0.01 | 1.06 ± 0.01 | 62.7 ± 0.3 |
| | $d_{pl}$ = 40 | 5.0 wt % | $5.1\times10^{-2}$ | | | |
| CS 4 | $d_{ps}$ = 10 | 0.5 wt % | $5.3\times10^{-3}$ | 1.26 ± 0.01 | 1.06 ± 0.01 | 62.9 ± 0.3 |
| | $d_{pl}$ = 20 | 0.5 wt % | $5.3\times10^{-3}$ | | | |

Next, a flexible tube is connected to a syringe filled with the pure liquid (glycerol), which is the working fluid behind the bubble. A short length at the end of the flexible tubing is left unfilled so that an air plug forms upon connecting the tubing to the glass capillary and starting the syringe pump at the flow rate of interest. A sequence of bright-field images is captured at the center-plane of the glass capillary as the bubble translates along the channel.

The glass capillary is connected to the syringe by a 3 cm-long, flexible TEFLON® PTFE tube, whose outer diameter fits in the inner diameter of the glass capillary. Two different working fluids are used ahead and behind the bubble, respectively. Before the experiment starts, the glass capillary is filled with working fluid 1, which is the working fluid ahead of the bubble. A new flexible tube is then connected to a syringe filled with working fluid 2, which serves as the working fluid behind the bubble. Setting the syringe pump to a low flow rate (2 μl $min^{-1}$), the flexible tube is partially filled with working fluid 2. With the flexible tube partially unfilled, the tube is carefully inserted into the glass capillary. The length of the long, confined bubble is controlled by the volume of the air column left in the flexible tube.

The glass capillary is further submerged in a box of pure glycerol, which is contained in a transparent rectangular box with a bottom. The matching refractive indices of the working fluid, glass capillary and the surrounding fluid in the box guarantee minimal optical distortion and/or internal reflection in the images due to the curvature of the capillary tube. A collimated LED light source is located beneath the glycerol-filled box, and a camera (Nikon D5100 DSLR), which is equipped with a 10× long-working distance objective (Mitutoyo) mounted on a homemade tube microscope, is located above the box. The imaging apparatus is aligned vertically using a digital protractor (Mitutoyo). The glycerol-filled box is fixed such that the capillary tube is oriented horizontally and the camera's region of interest (ROI) is located on the horizontal center-plane of the channel.

The experiment is started by setting the syringe pump to the target flow rate. Bright-field image sequences were recorded at a fixed point located 15 cm downstream of the inlet at the rate of 30 frames per second.

The bubble velocity $U_b$ and the thickness of the uniform annular gap b are measured using the Orthogonal View function in Image) based on the recorded images. Two perpendicular reference lines are located on the unprocessed image (one along the axis of the channel, one across the channel). As the bubble translates in the image sequence, the pixels along the reference lines at each snapshot will be stacked in time to form the time-strip images. The tube diameter 2R and the uniform film thickness b can be measured from the time-strip images using the reference line across the channel. Note that the horizontal direction of the time-strip images represent time, so that the bubble velocity $U_b$ can be obtained from the time-strip images using the reference line along the axis of the channel, where the slopes of the two dark strips represent the bubble nose and rear cap velocities, respectively.

In the first experiment, a $Ca=1.34\times10^{-2}$ using CS1 in front of the bubble was chosen. Based on the prediction of the film thickness from Eq. (1), this configuration allows testing the condition where $d_p/b<1$. An annular stream of CS leaked through the thin film region and reached the fluid at the back of the bubble. In contrast, in the second experiment, using a suspension of larger particles (CS2) in front of the bubble translating at the same Ca, leading to condition where $d_p/b>1$, no particle reached the liquid behind the bubble. The larger particles were, however, found forming a monolayer coating at the back of the bubble. Thus, no larger particles were allowed to freely enter and move through the volume of space behind the bubble. Instead, the larger particles remained at the interface.

In order to test the sensitivity of the system to the thickness of the liquid gap, a third experiment was run where the Ca downstream was increased to reach the condition $d_p/b<1$ again. In comparison to when $d_p/b>1$, the thicker liquid gap at higher Ca allows the same 40 μm particles to leak towards the back of the bubble, i.e., the gap size and the bubble-driven filtration capacity can be tuned in-situ simply by varying the flow rate of the liquid phase.

Figure 5:
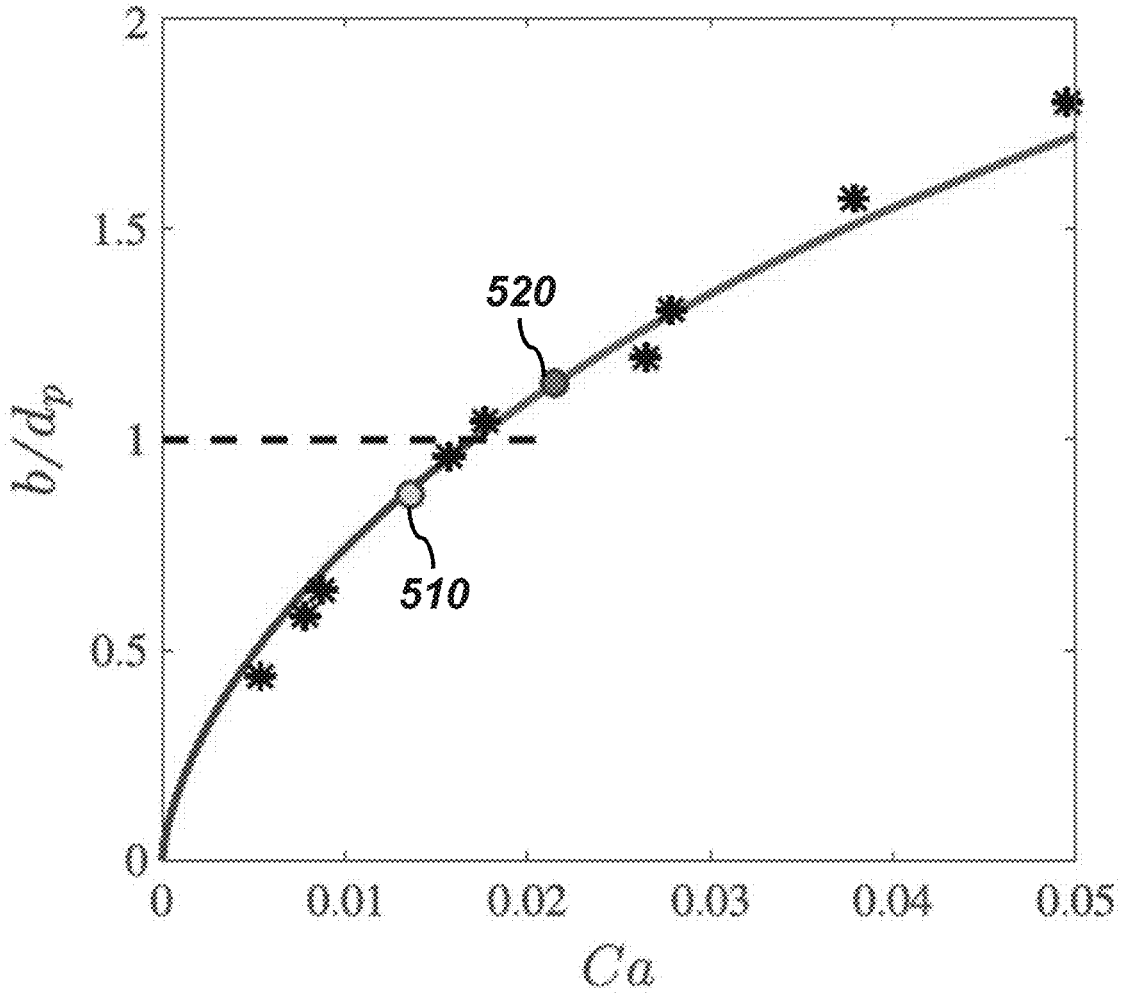
FIG. 5 is a graph showing the ability to control filtration as velocity of the bubble changes.

Referring to FIG. 5, experiments were performed by systematically varying the speed of the bubble and consequently the capillary number in the range $5\times10^{-3}<Ca<5\times10^{-2}$, while keeping a constant particle diameter of $d_p=40$ μm. The results demonstrate the particle-filtering capability of the system without modifying the setup. As presented in FIG. 5, the threshold for the relative film thickness to allow passage of particles from the front to the back of the bubble is close to $b/d_p=1$, as predicted. The value where $b/d_p$ and Ca matches the second experiment above is shown as the first closed circle 510. As shown, $b/d_p<1$ and the particles were filtered by the bubble, which matches the results of the second experiment. The value where $b/d_p$ and Ca matches the third experiment above is shown as the first closed circle 520. As shown, $b/d_p>1$ and the particles leaked past the bubble, which matches the results of the third experiment.

Of note, coating the bubble by a monolayer of larger particles modifies the boundary condition at the bubble interface, causing an increase in the film thickness in the coated section of the interface, and thus naturally prevents clogging of the system.

Different working fluids were used ahead (CSes) and behind (pure glycerol) the bubble. The pure liquid at the back of the bubble provides a reservoir to collect the separated particles in the system. Regardless of the ratio $d_p/b$, no specific interaction occurs between the bubble interface and the colloids if the CS is placed behind the bubble instead, if the front is pure glycerol. Therefore, the fluid at the back of the bubble does not affect the particle filtration or transport process, which allows a preferential direction in the filtration process. In general, irreversibility is a desirable feature in filtration and/or separation processes, i.e. particles separated from a CS are to be kept away from the original solution at all time. The directional feature demonstrates that the disclosed system serves this goal.

The interaction between the surface of a confined bubble and a bidisperse suspension were examined. This is referred to as separation, and the corresponding capacity of the bubble-driven system for a bidisperse CS composed of small and large colloids of diameters $d_{ps}$ and $d_{pl}$ in glycerol can be tested. In each experiment, the capillary number Ca is adjusted so that the corresponding thickness of the annular gap falls in between the two particle sizes, $d_{ps}<b<d_{pl}$. The system is initially filled with the bidisperse CS followed by a confined bubble and pure glycerol behind the bubble, which serves as a collection reservoir for the smaller particles with diameter $d_{ps}$.

The particle size distributions are analyzed in the working fluids ahead and behind the confined bubble after each bidisperse suspension separation experiment. After the bubble passes through the image sequence recording location, a sample vial is placed at the outlet of the glass capillary, collecting the working fluid ahead the bubble until the bubble is about to exit through the capillary. The syringe pump is paused when the bubble has exited, and the flexible tubing is carefully removed from the glass capillary, where the working fluid behind the bubble is stored.

In order to collect all of the separated particles in the working fluid behind the bubble, a new TEFLON® PTFE tubing connected to a glycerol-filled syringe is used to insert a new bubble to the glass capillary. The syringe pump is then operated at a low flow rate (5 μl $min^{-1}$), ensuring that no separated particles can leak behind the new bubble. Meanwhile, another vial is placed at the outlet of the glass capillary to collect the working fluid until the new bubble has exited the glass capillary.

After collecting the working fluids, the particle size distribution is analyzed under a microscope (Leica DMI4000B). For each examination, a sample of 200 μl volume from the working fluid is deposited on a clean 25 mm×75 mm glass slide and covered by a 18 mm×18 mm cover slip. The number of particles and their diameters are then measured using the Analyze Particles function in ImageJ, which allows quantifying the particle size distribution in these samples.

First, a bidisperse suspension CS3 (see Table 1) was used. The volume fraction ratio $\phi_l/\phi_s=10$ was chosen to intensify the separation effect, since the number density ratio would be $n_s/n_l=(d_{pl}/d_{ps})^3=64$ if the same volume fractions were used. As the bubble translates through CS3 at $Ca=8.65\times10^{-3}$, a clean uniform film of thickness b=26.0 μm was formed at the wall. Initially, both large and small particles enter the thin film region. While all larger particles were captured and collected at the rear section of the bubble interface, the majority of the smaller particles originally in the thin film region leaked to the fluid behind the bubble. As a result, the smaller particles were separated from the bidisperse suspension.

A histogram comparing the particle number densities before and after the experiment was produced. Compared to the particle size distribution before the experiment, the peaks for large particles were eliminated after the bubble passes by, with the separation rate for small particles being 100% for this specific experiment.

A second experiment was performed with a more challenging sample, bidisperse suspension CS4 (see Table 1). The volume fraction is chosen to be the same in this case, since the particle size difference is much smaller in this suspension. The bubble translates through CS4 at $Ca=4.24\times10^{-3}$, leaving a uniform thin film of thickness b=17.0 μm. Both large and small particles enter the thin film region. Particle size distributions before and after the experiment were created, showing a much-reduced peak for the large particles. A close examination showed that the number density ratio $n_s/n_l$ in the samples increase from 3.98 (before the experiment) to 34.5 (after the experiment), which indicates a significant reduction of large particles after the separation process. The current separation method makes use of the relative size between the particle diameter $d_p$ and the uniform film thickness b.

It is noted that when the bubble interface is completely coated with particles, the thickness of the uniform film will increase up to $2^{2/3}$ times of the original value, after which large particles may also leak to the back of the bubble. However, this is also a beneficial self-healing feature of the system in terms of preventing clogging at all times. Additionally, particle monolayer buckling can occur at the rear stagnation ring if the monolayer area exceeds a critical value. The buckling feature is caused by a critical compressive interfacial shear, over which the rigid particles fail to rearrange, where little non-Newtonian response should be expected. Therefore, there is a maximum length of a bubble that can prevent buckling from occurring, which ensures a desirable separation process. But both limitations can be overcome by inserting new bubbles into the tube, to ensure continuous success of the separation process.

The example particle separation process makes use of a millimeter scale capillary tube, and thus provides a chance for scaling up the particle separation process. This process also provides a flexible way to separate different polydisperse particle batches in the same experimental set-up, since the critical dimension—the thickness of the uniform fluid film around the bubble—is only determined by the capillary number Ca, which can be well-controlled by solely manipulating the flow rate of the incoming flow.

Those skilled in the art will recognize or be able to ascertain using no more than routine experimentation, many equivalents to the specific embodiments of the invention described herein. Such equivalents are intended to be encompassed by the following claims.

What is claimed is:

1. A system for separating suspended particles, comprising:

at least one channel having an inner surface with a first fixed diameter, the inner surface defining a first opening at a first end of the channel and a second opening at a second end of the channel;

a plurality of particles within a first fluid in the at least one channel, the plurality of particles comprising a first and second particle, the first particle having different dimensions from the second particle; and a non-spherical bubble within the first fluid, the bubble comprising a second fluid and having a bubble length and diameter, the bubble configured to have a gap between an outer surface of the bubble and an inner surface of the at least one channel such that the bubble is not in contact with the channel, wherein the device is configured such that a thickness of the gap is capable of being controlled by a flow rate within the channel.

2. The system according to claim 1, wherein the outer surface of the bubble and the inner surface of the at least one channel defines an annular gap having a uniform thickness, the uniform thickness being smaller than at least one second diameter of at least one of the plurality of particles.

3. The system according to claim 1, wherein the flow rate of the first fluid is controlled such that the capillary number (Ca) is $1\times10^{-4}<Ca<2$.

4. The system according to claim 1, wherein each particle has a density substantially equal to a density of the fluid.

5. The system according to claim 1, wherein there exists attractive intermolecular interactions between the particles and the interface between the first and second fluids.

6. The system according to claim 1, wherein the second fluid comprises a gas.

7. The system according to claim 1, wherein the second fluid comprises a liquid.

8. The system according to claim 1, wherein an axis of the at least one channel is oriented in a substantially vertical or substantially horizontal direction.

9. The system according to claim 1, further comprising a pump or syringe operably connected to the first opening.

10. The system according to claim 1, wherein the thickness of the gap is capable of being adjusted to be between about 0.1 μm and about 1 mm.

11. The system according to claim 1, further comprising a camera configured to receive light passing through the at least one channel.

12. The system according to claim 1, wherein the device comprises a plurality of channels.

13. A method for separating particles in a fluid, comprising the steps of:

flowing at least a first and second particle suspended in a first fluid into a first end of a channel, the first and second particles having different dimensions;

creating a first bubble at the first end of the channel, the first bubble having a bubble length and diameter, the first bubble not being in contact with the channel, and an outer surface of the first bubble and an inner surface of the channel defining a gap; and controlling a flow rate within the channel such that the gap has a uniform thickness insufficiently large to allow the first suspended particle to enter a volume of space upstream of the first bubble, but sufficiently large to allow the second suspended particle to enter a volume of space upstream of the first bubble.

14. The method according to claim 13, further comprising flowing additional first fluid without suspended particles into the channel after the first bubble.

15. The method according to claim 13, further comprising generating a second bubble in the at least one channel, the second bubble being upstream of the first bubble.

16. The method according to claim 15, further comprising flowing additional first fluid without suspended particles into the channel after generating the second bubble.

17. The method according to claim 13, further comprising absorbing the first particle on an interface of the bubble.

18. The method according to claim 13, wherein the first and second particles have a minimum characteristic dimension of between 0.1 μm and 1 mm.

19. A method for separating particles in a fluid, comprising the steps of:

flowing at least a first and second particle suspended in a first fluid into a first end of a channel;

creating a first bubble at the first end of the channel, the first bubble having a bubble length and diameter, the first bubble not being in contact with the channel, and an outer surface of the first bubble and an inner surface of the channel defining a gap; and controlling a flow rate within the channel such that the gap has a uniform thickness insufficiently large to allow the first suspended particle to enter a volume of space upstream of the first bubble; and collecting a sample of the first fluid ahead of the bubble and quantifying particle size distribution.

20. A method for separating particles in a fluid, comprising the steps of:

flowing at least a first and second particle suspended in a first fluid into a first end of a channel;

creating a first bubble at the first end of the channel, the first bubble having a bubble length and diameter, the first bubble not being in contact with the channel, and an outer surface of the first bubble and an inner surface of the channel defining a gap; and controlling a flow rate within the channel such that the gap has a uniform thickness insufficiently large to allow the first suspended particle to enter a volume of space upstream of the first bubble; and collecting a sample of the first fluid after the bubble and quantifying particle size distribution.

* * * * *